United States Patent [19]

Fujiwara et al.

[11] Patent Number: 4,662,176

[45] Date of Patent: May 5, 1987

[54] HEAT EXCHANGER FOR A STIRLING ENGINE

[75] Inventors: Michio Fujiwara; Yoshio Kazumoto; Tamotsu Nomaguchi; Kazunori Tsuchino; Kazuhiko Kawajiri; Youichi Hisamori, all of Amagasaki, Japan

[73] Assignee: Mitsubishi Denki Kabushiki Kaisha, Tokyo, Japan

[21] Appl. No.: 851,443

[22] Filed: Apr. 14, 1986

[30] Foreign Application Priority Data

| | | | |
|---|---|---|---|
| Apr. 15, 1985 | [JP] | Japan | 60-79582 |
| Apr. 15, 1985 | [JP] | Japan | 60-79583 |
| Apr. 15, 1985 | [JP] | Japan | 60-79584 |
| Aug. 8, 1985 | [JP] | Japan | 60-174496 |

[51] Int. Cl.[4] ..... F02G 1/04

[52] U.S. Cl. ..... 60/526; 60/517

[58] Field of Search ..... 60/517, 526

[56] References Cited

U.S. PATENT DOCUMENTS

| | | | |
|---|---|---|---|
| 3,384,166 | 5/1968 | Hayden | 165/164 |
| 4,085,588 | 4/1978 | Reams | 60/517 |
| 4,422,291 | 12/1983 | Berntell | 60/517 |
| 4,478,042 | 10/1984 | Lorant | 60/517 X |

FOREIGN PATENT DOCUMENTS

| | | |
|---|---|---|
| 3134768 | 3/1983 | Fed. Rep. of Germany . |
| 1017657 | 12/1952 | France . |
| 1032238 | 6/1953 | France . |
| 58-178852 | 10/1983 | Japan . |

*Primary Examiner*—Allen M. Ostrager

*Attorney, Agent, or Firm*—Leydig, Voit & Mayer

[57] ABSTRACT

A heat exchanger for a Stirling engine has a domed cylinder which serves as a high-temperature cylinder and a regenerator housing. The domed cylinder has a smoothly-changing cross-sectional shape so that stress concentrations will not develop therein. A thin inner liner which is inserted into the domed cylinder divides the inside of the domed cylinder into an expansion space and a regenerator space. A cylindrical regenerator is coaxially disposed inside the regenerator space. A cylindrical cooler is coaxially disposed below the regenerator with its inner surface forming the outer periphery of the compression space of the engine. The expansion space and the regenerator space are connected with one another by a plurality of heater tubes which are secured to the domed cylinder.

7 Claims, 7 Drawing Figures

HEAT EXCHANGER FOR A STIRLING ENGINE

BACKGROUND OF THE INVENTION

This invention relates to a heat exchanger for a Stirling engine.

FIG. 1 illustrates a conventional heat exchanger for a Stirling engine which was disclosed in Japanese Laid-Open Patent Application No. 52-25952. In the figure, element number 1 is a high-temperature cylinder, element number 1*a* is an expansion space which is defined by the top portion of the high-temperature cylinder 1, element number 2 is a cylindrical regenerator housing which concentrically surrounds the high-temperature cylinder 1 and is secured thereto at its upper end, and element number 3 is a low-temperature cylinder which is secured to the regenerator housing 2 by securing bolts 102. A hermetic seal is formed between the high-temperature cylinder 1 and the low temperature cylinder 3 by an O-ring seal 3*b*. Element number 3*a* is a compression space which is defined by the bottom portion of the high-temperature cylinder 1 and the top portion of the low-temperature cylinder 3. Elements number 4 are a plurality of heater tubes which extend outwards from the head of the high-temperature cylinder 1 and which connect to the head portion of the regenerator housing 2. Element number 5 is a cylindrical regenerator which is made of a wire mesh or the like and which is disposed inside the regenerator housing, concentrically surrounding the high-temperature cylinder 1. Element number 6 is a cylindrical cooler which is disposed below the regenerator 5 and which concentrically surrounds the lower portion of the high-temperature cylinder 1. Element number 6*a* is one of a number of axially-extending cooling pipes which form part of the cooler 6 and which are connected thereto by soldering or other means. Elements numbers 6*b* and 6*c* are O-ring seals which form a hermetic seal between the cooler 6 and the regenerator housing 2. Elements numbers 7 and 8 are respectively a cooling water intake pipe and a cooling water discharge pipe through which cooling water passes for the cooler 6. Element number 9 is a displacer having a hollow, sealed center, and element number 10 is a gas seal ring which is mounted on the displacer 9 and forms a seal between the displacer 9 and the inner surface of the high-temperature cylinder 1. Element number 101 is a rod seal which is provided in the central shaft portion of a power piston 11 and which forms a seal between the power piston 11 and a displacer rod 13 which passes through the center of the power piston 11 and is connected to the displacer 9. Element number 12 is a gas seal ring which is mounted on the outside of the power piston 11 and forms a seal between it and the inner surface of the low-temperature cylinder 3. Element number 14 is a power piston rod which is secured to the power piston 11. The bottom portion of the low-temperature cylinder 3 serves as a crankcase. The crankcase is equipped with a crank mechanism and connecting rods which reciprocate the displacer 9 and the power piston 11 with a prescribed phase difference.

In a Stirling engine of this type, by continuously heating and cooling the heater tubes 4 and the cooler 6, respectively, a working fluid is expanded and compressed, and the working fluid flows back and forth inside the heat exchanger. Namely, the working fluid flows from the heater tubes 4 to the cooler 6 through the regenerator 5 or in the opposite direction. The thermal energy which is transferred to the heater tubes 4 is converted into the rotational energy of a crankshaft through the reciprocation of the piston 11 and the displacer 9.

A conventional heat exchanger of the type illustrated in FIG. 1 has a number of problems. First, as the high-temperature cylinder 1 and the regenerator housing 2 must be able to withstand an internal pressure of approximately 10–60 atmospheres, their walls must be made very thick. As a result, the thermal conduction losses from the high-temperature cylinder 1 to the cooler 6 through the regenerator housing 2 are large, and the thermal efficiency of the engine ends up being poor. Furthermore, at the portion where the high-temperature cylinder 1 is connected to the regenerator housing 2, there is an abrupt change in cross-sectional area. As a result, large concentrations of welding stresses and thermal stresses can develop at this portion, and damage due to high stresses can easily occur.

SUMMARY OF THE INVENTION

It is an object of the present invention to overcome the above-described drawbacks of conventional heat exchangers and to provide a heat exchanger for a Stirling engine in which thermal conduction losses from a high-temperature cylinder to a cooler are greatly decreased.

It is another object of the present invention to provide a heat exchanger for a Stirling engine in which stress concentrations in the high-temperature cylinder of the engine can be greatly reduced.

It is still another object of the present invention to provide a heat exchanger for a Stirling engine in which thermal stresses in the high-temperature cylinder and in heater tubes are greatly reduced.

It is yet another object of the present invention to provide a heat exchanger for a Stirling engine which can be easily assembled.

In a heat exchanger for a Stirling engine according to the present invention, a high-temperature cylinder and a regenerator housing are combined in a single member in the form of a domed cylinder having a domed portion and a cylindrical portion. The domed cylinder has a smoothly changing cross section with no sharp transition between the portion which serves as a high-temperature cylinder and the portion which serves as a regenerator housing, thus reducing stress concentrations. The inside of the domed cylinder is divided into an expansion space inside which a displacer reciprocates and a regenerator space which contains a regenerator by a thin, metallic inner liner which is disposed inside the domed cylinder coaxially therewith.

The expansion space is defined by the inner surface of the inner liner. The internl pressure acting on the inner liner is reacted by the domed cylinder, as a result of which the net pressure acting on the inner liner is very low and its walls can be very thin. Thermal conduction losses are therefore decreased and the efficiency of the engine as a whole can be increased.

BRIEF DESCRIPTION OF THE DRAWINGS

In the drawings, the same reference numerals indicate the same or corresponding parts.

DESCRIPTION OF THE PREFERRED EMBODIMENTS

Figure 2:
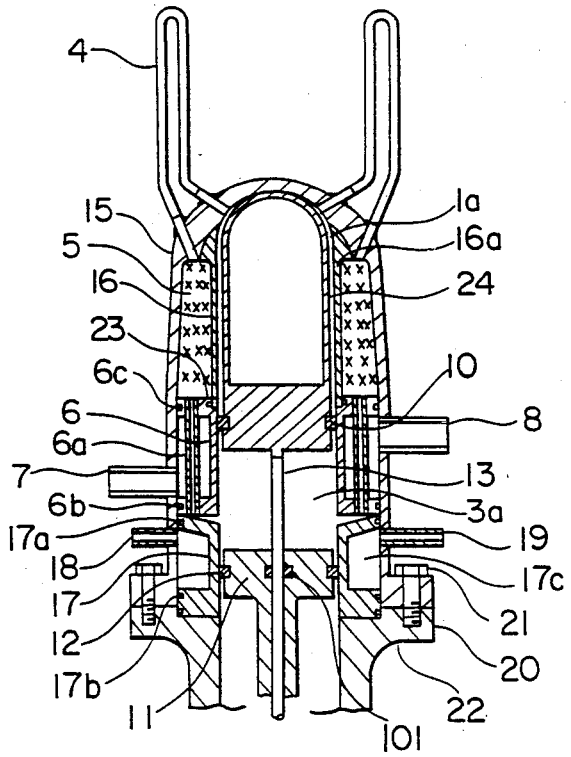
FIG. 2 is a longitudinal cross-sectional view of a first embodiment of a heat exchanger for a Stirling engine according to the present invention.

Hereinbelow, a number of preferred embodiments of a heat exchanger for a Stirling engine according to the present invention will be described while referring to FIGS. 2 through 7 of the accompanying drawings. FIG. 2 illustrates a first embodiment of the present invention applied to a Stirling engine. A heat exchanger according to the present invention has a domed cylinder 15 having a sealed, domed upper portion which serves as a high-temperature cylinder and an open-ended, cylindrical lower portion which is integrally formed with the domed portion and which serves as a regenerator housing. The bottom end of the cylindrical portion of the domed cylinder 15 has a flange which is connected to the upper flange 20 of a crankcase by bolts 21. The domed cylinder 15 is made of a heat-resistant metal such as Hastelloy X (a tradename of Union Carbide). It has a smoothly-changing cross-sectional shape in the section where the domed portion connects to the cylindrical portion. A generally cylindrical inner liner 16 is inserted into the upper portion of the domed cylinder 15. The upper portion of the inner liner 16 has a curved outer surface which, at operating temperatures, fits tightly against the inner surface of the domed portion of the domed cylinder 15. In its lower portion, the inner liner 16 has an outer diameter that is smaller than the inner diameter of the cylindrical portion of the domed cylinder 15 so that it divides the inside of the domed cylinder 15 into an expansion space 1*a* on the inside of the inner liner 16 and a regenerator space between the inner liner 16 and the cylindrical portion of the domed cylinder 15. A conventional regenerator 5 is disposed inside this regenerator space. The regenerator 5 surrounds the inner liner 16 and fits inside a recessed portion 16*a* of the inner liner 16. A number of conventional heater tubes 4 are secured to the domed portion of the domed cylinder 15 so as to communicate between the expansion space 1*a* and the regenerator space.

Figure 1:
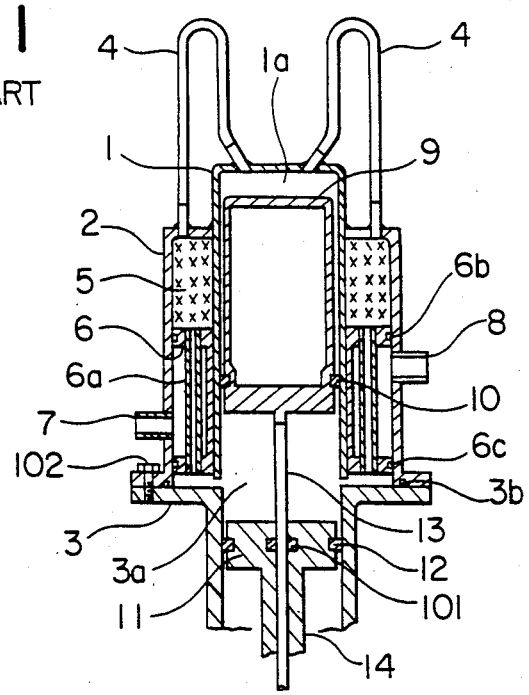
FIG. 1 PRIOR ART
FIG. 1 is a longitudinal cross-sectional view of a conventional heat exchanger for a Stirling engine.

Below the regenerator 5 is a conventional cooler 6 which is coaxially disposed with respect to the inner liner 16. The cooler 6 has a ledge formed in its upper portion along its inner periphery, and the cooler 6 fits over the bottom portion of the inner liner 16 with the bottom portion of the inner liner 16 sitting on this ledge. The joint between the inner liner 16 and the cooler 6 is sealed by an O-ring seal 23. The inner surface of the cooler 6 forms the outer periphery of a compression space 3*a* along which a displacer 24 slides. This displacer 24 is similar to the conventional displacer 9 of FIG. 1 but has a domed upper portion which conforms with the shape of the domed portion of the domed cylinder 15. The inner surface of the cooler 6 is in sliding contact with a gas seal ring 10 mounted on the outside of the displacer 24. The cooler 6 is cooled by cooling water which passes through an intake pipe 7 and a discharge pipe 8 which are secured to the domed cylinder so as to communicate with the inside of the cooler 6.

A compression cylinder 17 is provided below the cooler 6 at the lower end of the domed cylinder 15. The compression cylinder 17 is coaxially disposed with respect to the cooler 6 and has the same inner diameter. Like the inner surface of the cooler 6, the inner surface of the compression cylinder 17 defines the outer periphery of the compression space 3*a* along which a conventional power piston 11 slides. Its inner surface is in sliding contact with a gas seal ring 12 which mounted on the outside of the power piston 11. A portion of the outer periphery of the compression cylinder 17 is in contact with the inner surface of the domed cylinder 15, and O-ring seals 17*a* and 17*b* are provided at these portions to form a hermetic seal between the domed cylinder 15 and the compression cylinder 17. The compression cylinder 17 also has an annular cavity 17*c* formed therein which opens onto the inner surface of the domed cylinder 15. This cavity 17*c* communicates with a cooling water intake pipe 18 and a cooling water discharge pipe 19 which are mounted on the domed cylinder 15 near its lower end. The compression cylinder 17 is cooled by cooling water which passes through the cavity 17*c* via the intake pipe 18 and the discharge pipe 19. The compression cylinder 17 sits on a ledge of the upper flange 20 of the crankcase, and a hermetic seal is formed between the bottom portion of the compression cylinder 17 and the ledge by an O-ring seal 22 which is mounted on the compression cylinder 17.

The bottom surface of the cooler 6 is separated from the top surface of the compression cylinder 17 by a gap, and the bottom ends of the cooling pipes 6*a* open onto this gap. The gap enables working fluid to flow from the compression space 3*a* and into the cooling pipes 6*a* or in the reverse direction via the gap.

The operation of a heat exchanger according to the present invention is identical to that of a conventional heat exchanger for a Stirling engine. Namely, working fluid flows back and forth from the expansion space 1*a* to the compression space 3*a* through the heater tubes 4, the regenerator 5, and the cooler 6 or in the opposite direction, and thermal energy which is transferred to the heater tubes 4 is used to reciprocate the power piston 11 and the displacer 9. As the inner liner 16 fits tightly against the inner surface of the domed cylinder 15 at operating temperatures, the working fluid can not leak from the expansion space 1*a* to the regnerator 5.

In a heat exchanger according to the present invention, the pressure which acts on both wall surfaces of the inner liner 16 is reacted by the walls of the domed cylinder 15, and the net pressure acting on the inner liner is only about 0.2 atmospheres when the working fluid flows through the heater tubes 4. For this reason, the walls of the inner liner 16 can be made extremely thin. Thermal conduction losses from the high-temperature cylinder to the cooler 6 can therefore be decreased, and the thermal efficiency of the engine can be increased.

Furthermore, because the domed cylinder 15 is a single member with no sudden changes in cross-sectional shape, there are no stress concentrations such as develop in a conventional heat exchanger at the joint between the high-temperature cylinder and the regenerator housing, and the durability of the heat exchanger and the engine are increased.

Figure 3:
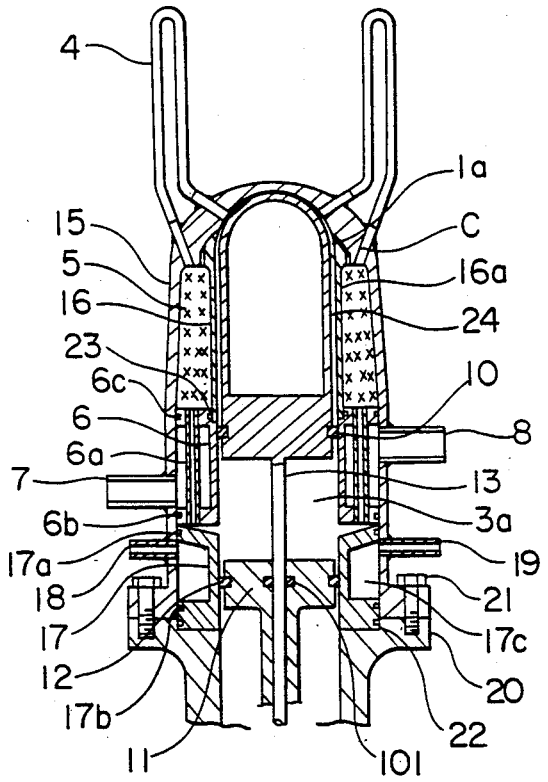
FIG. 3 is a longitudinal cross-sectional view of the embodiment of FIG. 2 illustrating the provision of a gap C between the upper portion of the inner liner and the domed cylinder.

Although it is important that the upper portion of the inner liner 16 fit tightly against the domed portion of the domed cylinder 15 during operation, it is desirable that at room temperature the upper portion of the inner liner 16 fit loosely inside the domed cylinder 15 so as to allow easier assembly. Since the domed cylinder 15 and the inner liner 16 will reach a temperature of about 700 degrees C. during operation, by choosing a material for the inner liner 16 which has a higher coefficient of linear expansion than the domed cylinder 15, it is possible to obtain a loose fit between the inner liner 16 and the domed cylinder 15 at room temperature and a tight, leakage-free fit at operating temperatures. For example, if the domed cylinder 15 is made of Hastelloy X, stainless steel or the like can be used for the inner liner 16. In this case, as shown in FIG. 3, at room temperature there is a gap C in the radial direction between the inner liner 16 and the domed cylinder 15 which enables the inner liner 16 to be easily inserted into the domed cylinder 15. At operating temperatures, due to the greater expansion of the inner liner 16, the gap C will disappear and the inner liner 16 will firmly contact the inner surface of the domed cylinder 15.

With this structure, the heat exchanger can be assembled quite easily by first fitting the regenerator 5 over the inner liner 16 outside of the domed cylinder 15 with the inner surface of the regenerator 5 contacting the recessed portion 16*a* of the inner liner 16. The inner liner 16 and the regenerator 5 can then be inserted into the domed cylinder 15 as a single unit.

Figure 4:
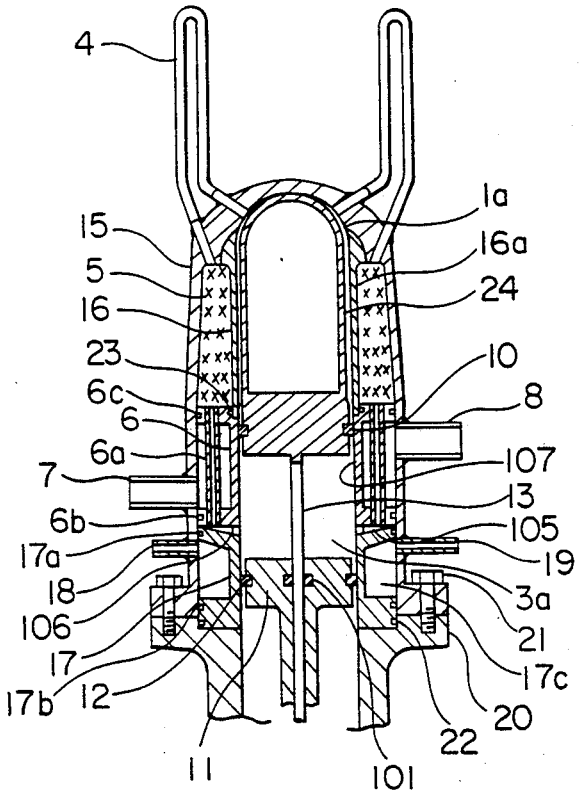
FIG. 4 is a longitudinal cross-sectional view of a second embodiment of a heat exchanger according to the present invention.
Figure 5:
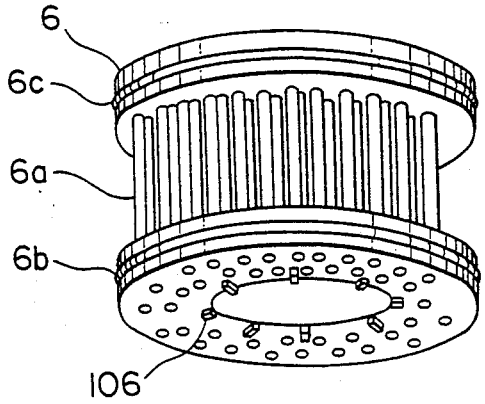
FIG. 5 is a perspective view of the cooler of the embodiment illustrated in FIG. 4.

FIGS. 4 and 5 illustrate a second embodiment of a heat exchanger according to the present invention. This embodiment is nearly identical in structure to the first embodiment of FIG. 2 except for the provision of downward-extending projections 106 on the bottom surface of the cooler 6. Each of these projections 106 has an inwards-facing surface which is flush with the inner surfaces of the cooler 6 and the compression cylinder 17. The bottom surface of each projection 106 contacts the top surface of the compression cylinder 17. These projections 106 prevent the O-ring seal 23 of the displacer 24 from entering the above-mentioned gap between the bottom surface of the cooler 6 and the top surface of the compression cylinder 17 during assembly, which could result in damage to the O-ring ring seal 23 due to the holes in the bottom surface of the cooler 6 which communicate with the cooling tubes 6*a*. As shown in FIG. 5, which is a perspective view of the cooler 6, in the present embodiment, 8 such projections 106 are equally spaced around the inner periphery of the cooler 6, but any number of projections 106 greater than two can be used as long as they can prevent the O-ring seal from entering the gap below the cooler 6. The operation of this embodiment is identical to that of the first embodiment.

Although in this second embodiment projections 106 are formed on the bottom surface of the cooler 6, it is possible to instead form similar projections on the top surface of the compression cylinder 17, the projections in this case extending upwards and contacting the bottom surface of the cooler 6.

As with the first embodiment, if at room temperature a gap C is provided between the upper portion of the inner liner 16 and the inner surface of the domed cylinder 15, and the inner liner 16 is made from a material having a larger coefficient of linear expansion than the domed cylinder 15, the assembly of the heat exchanger can be greatly simplified.

Figure 6:
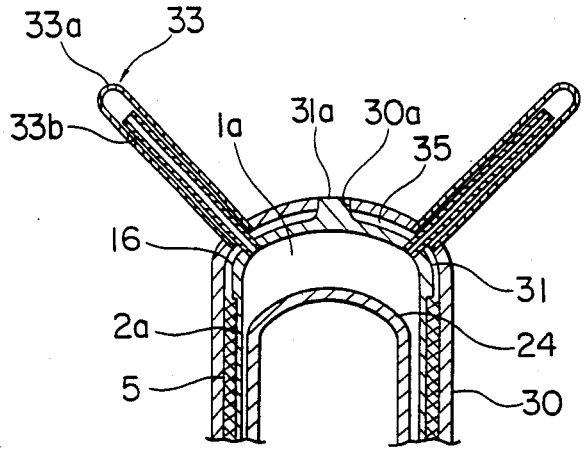
FIG. 6 is a longitudinal cross-sectional view of the top portion of a third embodiment of a heat exchanger according to the present invention.

FIG. 6 illustrates a portion of a third embodiment of a heat exchanger according to the present invention. In this embodiment, a domed cylinder 30 similar in shape to the domed cylinder 15 of the previous embodiments has a hole 30*a* formed at its peak along its axial center. The inside of the domed cylinder 30 is divided into an expansion space 1*a* and a regenerator space 2*a* by an inner liner 31. Unlike the inner liner 16 of the previous embodiments, this inner liner 31 has a sealed, dome-shaped upper portion on the top of which is formed a projection 31*a* which fits into the hole 30*a* in the domed cylinder 30 and is secured thereto by soldering or welding. A gap 35 is provided between the outer surface of the domed portion of the inner liner 31 and the inner surface of the domed portion of the domed cylinder 30, and the gap 35 communicates with the regenerator space 2*a*. During operation, this gap 35 serves as a gas conduit.

A heat exchanger according to this embodiment also has a plurality of double-walled heater tubes 33 secured to the domed cylinder 30. Each heater tube 33 comprises an outer tube 33*a* and a coaxially-disposed inner tube 33*b* whose outer surface is separated from the inner surface of the outer tube 33*a* by a gap for its entire length. Each outer tube 33*a* is sealed at its outer end while its inner end is secured to the domed cylinder 30 by soldering or welding so as to communicate with the gap 35 between the domed cylinder 30 and the inner liner 31. The outer end of each inner tube 33*b* opens onto the inside of the outer tube 33*a*, while its inner end is secured to the inner liner 31 by soldering or welding so as to communicate with the expansion space 1*a* formed inside of the inner liner 31. The structure of this heat exchanger is otherwise the same as that of either of the previous embodiments.

During the operation of this embodiment, a working fluid can flow from the expansion space 1*a* into the regenerator space 2*a* by passing along the inner cavity of the inner tube 31*b*, along the gap between the outer tube 31*a* and the inner tube 31*b*, along the gap 35 between the domed cylinder 30 and the inner liner 31, and into the regenerator space 2*a* or in the opposite direction. Except for the path taken by the gas in flowing from the expansion space 1*a* to the regenerator space 2*a*, the operation is identical to that of the previous embodiments.

This embodiment has the same advantage as the previous embodiments that due to the smooth shape of the domed cylinder 30, stress concentrations do not develop therein. In addition, because of the presence of the gap 35 between the domed cylinder 30 and the inner liner 31, the temperature distribution in the vertical direction in the upper portion of the domed cylinder 30 is made nearly uniform, reducing thermal stresses and allowing a reduction in the thickness of the walls of the domed cylinder 30. Furthermore, since the outer tube 33*a* and the inner tube 33*b* of each heater tube 33 are not connected with one another, differences in their thermal expansion do not result in stresses. As a result, with this embodiment, the thermal stresses in the heater tubes 33 are less than half those in the heater tubes 4 of the previous embodiments and their lifespans are accordingly increased.

Figure 7:
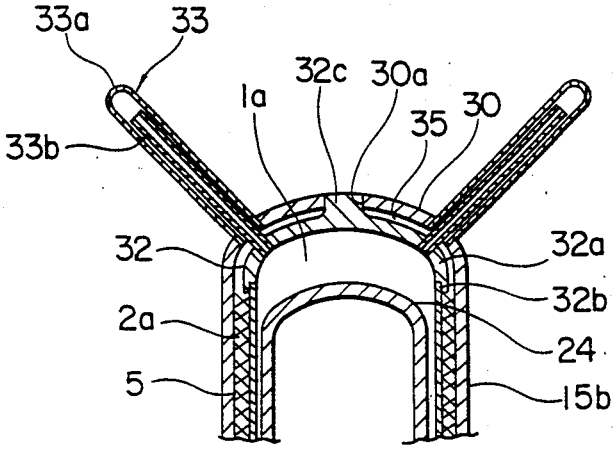
FIG. 7 is a longitudinal cross-sectional view of the top portion of a fourth embodiment of a heat exchanger according to the present invention.

FIG. 7 illustrates a fourth embodiment of the present invention. This embodiment is similar in structure to the previous embodiment, but it differs in that an inner liner 32 which divides a domed cylinder 30 into an expansion space 1*a* and a regenerator space 2*a* comprises a domed portion 32*a* and a cylindrical portion 32*b* which is detachable from the domed portion 32*a*. The domed portion 32*a* has a projection 32*c* which fits into a hole 30*a* in the top of the domed cylinder 30 and is secured thereto by soldering or welding. As in the previous embodiment, the domed portion 32*a* is separated from the inner surface of the domed cylinder 30 by a gap 35 which communicates with the regenerator space 2*a*.

Preferably, the cylindrical portion 32*b* is made of a material having a larger coefficient of linear expansion than the domed portion 32*a*, and the dimensions are such that at room temperature, the cylindrical portion 32*b* loosely fits inside the domed portion 32*a*, while at operating temperatures, the cylndrical portion 32*b* expands to achieve a tight fit between it and the domed portion 32*a*.

The operation of this embodiment is identical to that of the embodiment of FIG. 6, and it provides the further benefit that the manufacture and assembly of the inner liner 32 is simplified.

What is claimed is:

1. A heat exchanger for a Stirling engine comprising:

a domed cylinder having a domed portion and a cylindrical portion, the domed cylinder serving as a high-temperature cylinder and a regenerator housing of said Stirling engine;

a cylindrical inner liner which is coaxially disposed inside said domed cylinder and which divides the inside of said domed cylinder into an expansion space inside of said inner liner and a regenerator space between the outer surface of said inner liner and the inner surface of said cylindrical portion of said domed cylinder;

a cylindrical regenerator which is coaxially disposed with respect to said inner liner inside said regenerator space;

a cylindrical cooler which is coaxially disposed with respect to said inner liner below said cylindrical regenerator, said cooler having a cylindrical inner surface which forms the outer periphery of a compression space of said Stirling engine; and a heater tube which is mounted on said domed cylinder so as to communicate between the upper portion of said expansion space and said regenerator space.

2. A heat exchanger as claimed in claim 1, wherein:

said inner liner is made of a material having a larger coefficient of linear expansion than said domed cylinder; and the dimensions of said inner liner are such that at room temperature, a gap is formed between the outer surface of the upper portion of said inner liner and the inner surface of the domed portion of said domed cylinder, and that at operating temperatures, the upper portion of said inner liner fits tightly against the inner surface of the domed portion of said domed cylinder.

3. A heat exchanger as claimed in claim 1, wherein:

said cooler is disposed above a compression cylinder of said Stirling engine which has a cylindrical inner surface which is flush with the inner surface of said cooler, there being an axially-extending gap between the bottom portion of the cooler and the upper portion of the compression cylinder; and said cooler has a plurality of projections formed on its bottom surface which are spaced along its inner periphery, each of said projections having an inner surface which is flush with the inner surface of said cooler and having a length in the axial direction which is equal to the length of said gap between the bottom portion of said cooler and the upper portion of said compression cylinder.

4. A heat exchanger as claimed in claim 1, wherein:

said inner liner comprises a domed portion and a cylindrical portion which is connected thereto, said domed portion being supported by the upper portion of said domed cylinder, there being a gap between the outer surface of said domed portion of said inner liner and the inner surface of said domed portion of said domed cylinder which communicates with said regenerator space; and said heater tube communicates with said regenerator space via said gap.

5. A heat exchanger as claimed in claim 4, wherein said heater tube comprises:

an outer tube whose outer end is sealed and whose inner end communicates with said gap between the domed portion of said inner liner and said domed cylinder; and an inner tube which is coaxially disposed inside said outer tube with a gap therebetween, the outer end of said inner tube opening onto the inside of said outer tube, and the inner end of said inner tube communicating with the inside of said expansion space.

6. A heat exchanger as claimed in claim 4, wherein said domed portion and said cylindrical portion of said inner liner are a single member.

7. A heat exchanger as claimed in claim 4, wherein:

said domed portion and said cylindrical portion of said inner liner are separate members, said cylindrical portion of said inner liner having a larger coefficient of linear expansion than said domed portion of said inner liner, the dimensions of said cylindrical portion of said inner liner being such that at room temperature the upper portion of said cylindrical portion of said inner liner loosely fits inside said domed portion of said inner liner, and that at operating temperatures there is a tight fit between said cylindrical portion and said domed portion of said inner liner.

* * * * *